US005535492A

United States Patent [19]

Lai et al.

[11] Patent Number: 5,535,492

[45] Date of Patent: Jul. 16, 1996

[54] AUTOMATIC LOCK SLIDERS FOR SLIDE FASTENERS

[76] Inventors: Coach Lai, No. 123-1, Min-Tsu East Rd., Taipei, Taiwan; Sheng Y. Chen, No. 3, Alley 245, Sec. 3, Cheng-Tai Rd., Taipei Hsien, Taiwan

[21] Appl. No.: 337,450

[22] Filed: Nov. 8, 1994

[51] Int. Cl.[6] ..... A44B 19/00

[52] U.S. Cl. ..... 24/421; 24/420; 24/424

[58] Field of Search ..... 24/421, 420, 422, 24/423, 424, 425

[56] References Cited

U.S. PATENT DOCUMENTS

| | | | |
|---|---|---|---|
| 2,849,775 | 9/1958 | Erdmann | 24/421 |
| 3,320,645 | 5/1967 | Burbank | 24/421 |
| 4,644,613 | 2/1987 | Kedzierski | 24/421 |
| 4,976,014 | 12/1990 | Akashi et al. | 24/421 |
| 5,419,019 | 5/1995 | Ida | 24/421 |

FOREIGN PATENT DOCUMENTS

| | | | |
|---|---|---|---|
| 1121104 | 7/1956 | France | 24/424 |
| 2093521 | 9/1982 | United Kingdom | 24/424 |

*Primary Examiner*—Victor N. Sakran

*Attorney, Agent, or Firm*—Michael D. Bednarek; Marks & Murase

[57] ABSTRACT

An automatic lock slider for a slide fastener includes a flexible strip having, in addition to a first protrusion to be detachably inserted into the gap between the interlocked teeth, a second protrusion that is in the opposite direction of the first protrusion and can be biased to contact with the lug when the pull is pulled. The inner wall of the arch-shaped lug near the flared end of the slide body is provided with a stopper.

4 Claims, 9 Drawing Sheets

40

48

AUTOMATIC LOCK SLIDERS FOR SLIDE FASTENERS

BACKGROUND OF THE INVENTION

The present invention relates to a slider for a slide fastener, and in particular to an improved automatic lock slider for a slide fastener.

Referring to FIG. 1, the exploded perspective view of the structure of a conventional automatic lock slider for a slide fastener is shown. FIG. 2 is a diagram showing the conventional automatic lock slider for a slide fastener mounted on the stringers 50, 50' of a slide fastener. The slider 20 includes a slider body 22, a lug 24, a pull 30 and an elastic strip 28. The slider body 22 is composed of an upper side wall 221, a lower side wall 222, and a wedge-shaped diamond (not shown) which joins the upper side wall 221 to the lower side wall 222 and forms notches 223 for receiving the stringers 50, 50' (FIG. 2). The upper side wall 221 has a flared end 221*a* and a contracted end 221*b*. A lug 24 is integrally formed with the upper side wall 221 of the slider body 22 with its one end connected to the flared end 221*a* and the other end connected to the contracted end 221*b*, for connection with a pull 26. The pull 26 is provided with a wire loop 32 which is attached to the pull body 30 and forms an aperture 33 in which lug 24 and elastic strip 28 are disposed. The elastic strip 28, which is made of, for example metal, is disposed between the lug 24 and the upper side wall 221 of the slide body 22 with its fixed end being inserted into the hole 25 formed in one end of the lug 24 and its free end being positioned within a notch 241 formed in the connection at contracted end 221*b*. A downward protrusion 29 is formed at the free end of the elastic strip 28. Thus, when the pull 26 is released, the downward protrusion 29 will be inserted into the gap between the interlocked teeth due to the resilient property of the elastic strip 28, and thus the downward protrusion 29 will provide positive locking action on the stringers 50, 50' to prevent the slider 20 from moving. When the pull 26 is pulled, the elastic strip 28 is rotated around its fixing end, making its free end detach from the gap between the interlocked teeth and thus allowing the slider 20 move to open or close the slide fastener.

However, as shown in FIG. 1, for a conventional slider 20 of a slide fastener, when the elastic strip 28 is to be disposed between lug 24 and the upper slide wall 221, as the strip 28 is elastic and is in curved shape, and is to be passed over one end of the wire loop 32, sufficient space is needed for this installation. That is, the distance d should be high enough for the insertion of the elastic strip 28. However, when a sufficient space is provided, as shown in FIG. 2, the strip 28 will have a large space for deformation when it is pulled by the pull 26, rendering the quick elastic fatigue of the elastic strip 28. To avoid the above drawback, the height of the lug 24 should be reduced to prevent the elastic strip 28 from being excessively deformed when it is pulled. With the height of the lug 24 being reduced, the ring-shaped end of the pull 26, that is connected to the lug 24, can not but be made thinner to save the space. This is the reason why a wire loop 32 made of metal is usually used for this purpose. Another reason for using a metal wire loop 32 is to provide sufficient strength to the pull 26 to avoid its breakage. However, as the ring-shaped end is made with a metal wire loop which is usually of different material from that of the pull, the manufacturing cost is thus increased and such a combination can not be formed by the plastics injection molding technique.

SUMMARY OF THE INVENTION

It is therefore an object of the invention to provide an automatic lock slider for a slide fastener to eliminate the above disadvantages.

The above object of the invention is attained by providing a slider which includes an elastic strip having, in addition to a first protrusion to be detachably inserted into the gap between the interlocked teeth, a second protrusion that is in opposite direction of the first protrusion, and can be biased to contact with the lug when the pull is pulled, to prevent the elastic strip from being excessively deformed. In this manner, the ring-shaped end of the pull, defining the aperture circumscribing the lug and the elastic strip can be integrally formed by plastics injection molding, and thereby eliminating the drawbacks of conventional automatic lock sliders for slide fasteners.

BRIEF DESCRIPTION OF THE DRAWINGS

The present invention can be more fully understood by reading the subsequent detailed description of the preferred embodiment thereof with references to the accompanying drawings, wherein.

DETAILED DESCRIPTION OF THE INVENTION

Figure 1:
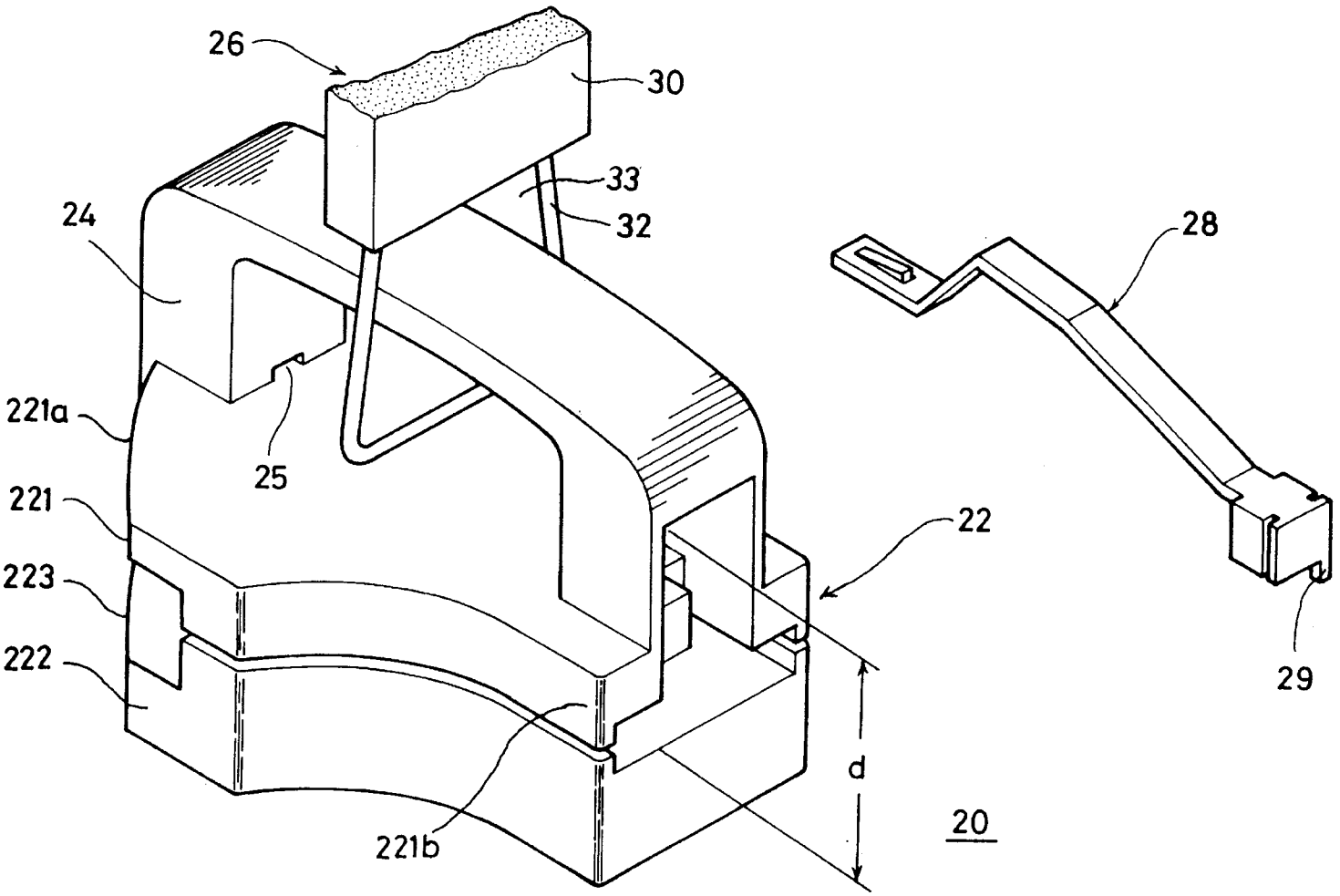
FIG. 1 (PRIOR ART)
FIG. 1 is an exploded perspective view of a conventional automatic lock slider for a slide fastener.
Figure 2:
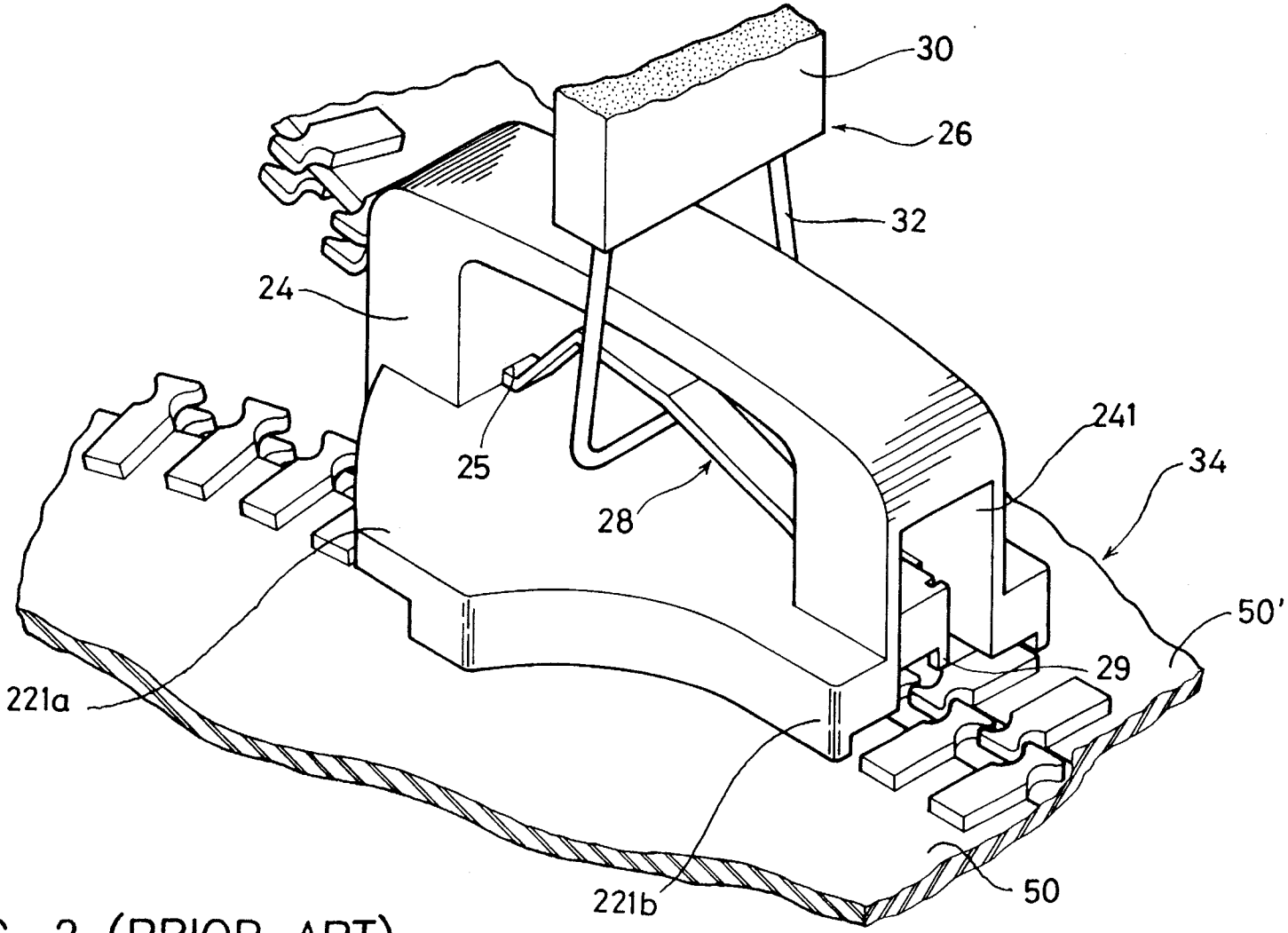
FIG. 2 (PRIOR ART)
FIG. 2 is a perspective view showing the conventional automatic lock slider mounted on the stringers.
Figure 3:
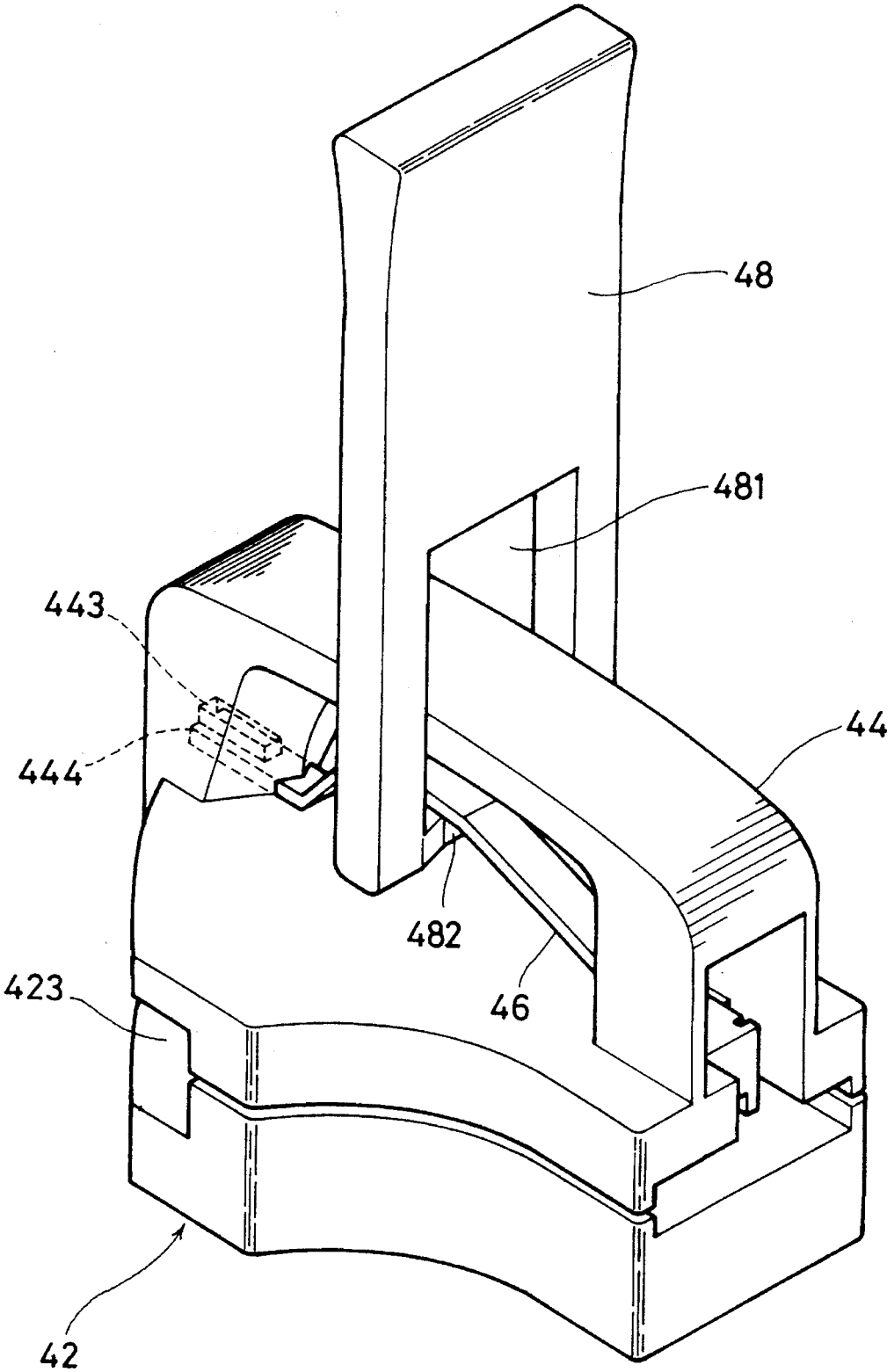
FIG. 3 is a perspective view of a preferred embodiment of the automatic lock slider of the invention.
Figure 4:
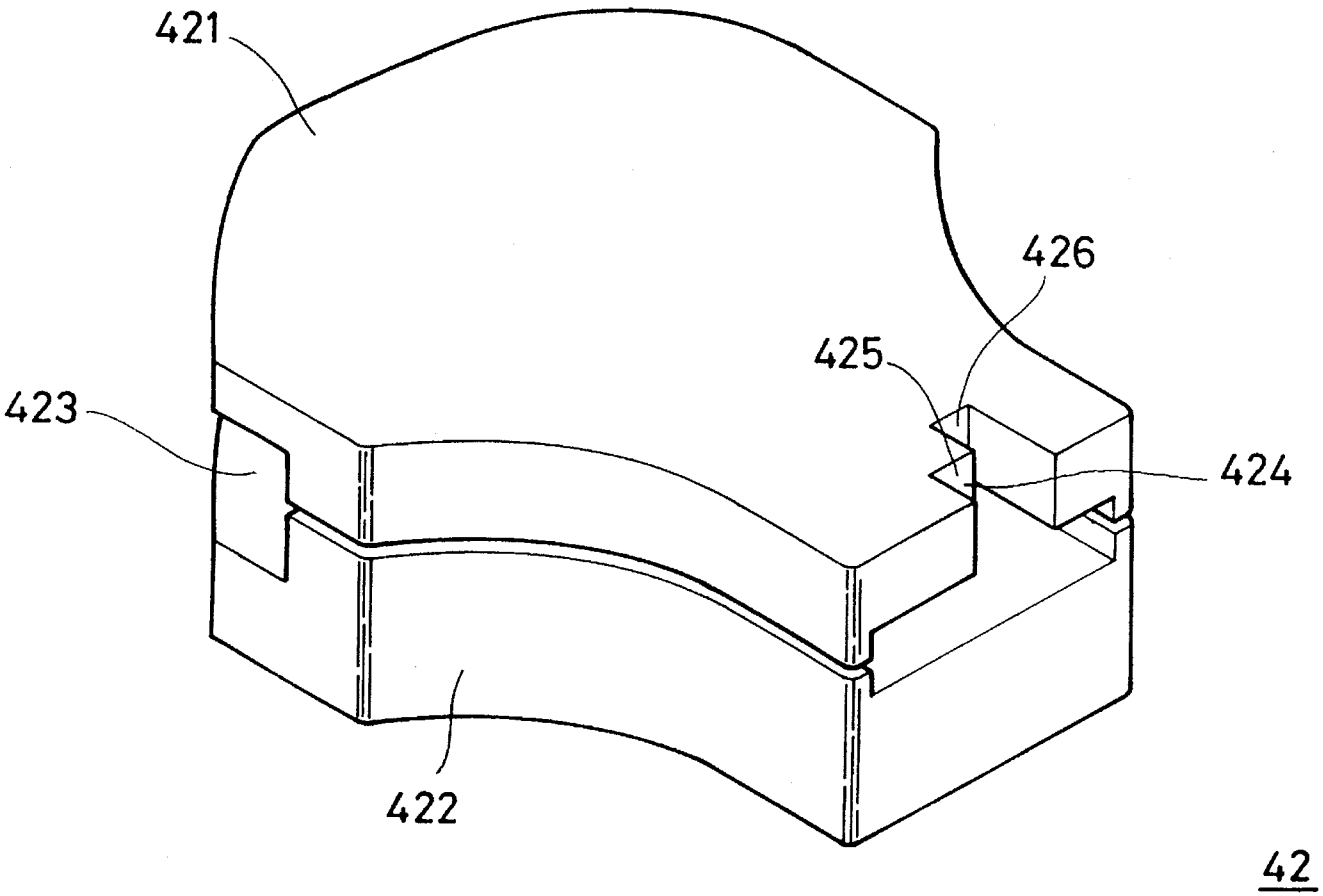
FIG. 4 is a perspective view of the slider body of the automatic lock slider of FIG. 3.

Referring now to FIG. 3, the automatic lock slider 40 of the present invention includes a slider body 42, a lug 44, an elastic strip 46 and a pull 48. A perspective view of the slider body 42 is shown in FIG. 4. As it is shown in FIG. 4, the slider body 42 includes an upper side wall 421, a lower side wall 422, and notches 423 formed between the upper side wall 421 and the lower side wall 422 for receiving the stringers (not shown). At the contracted end of the upper side wall 421, two slots 425, 426 having different lengths are formed adjacently so that a protruding portion 424 is formed.

Figure 5:
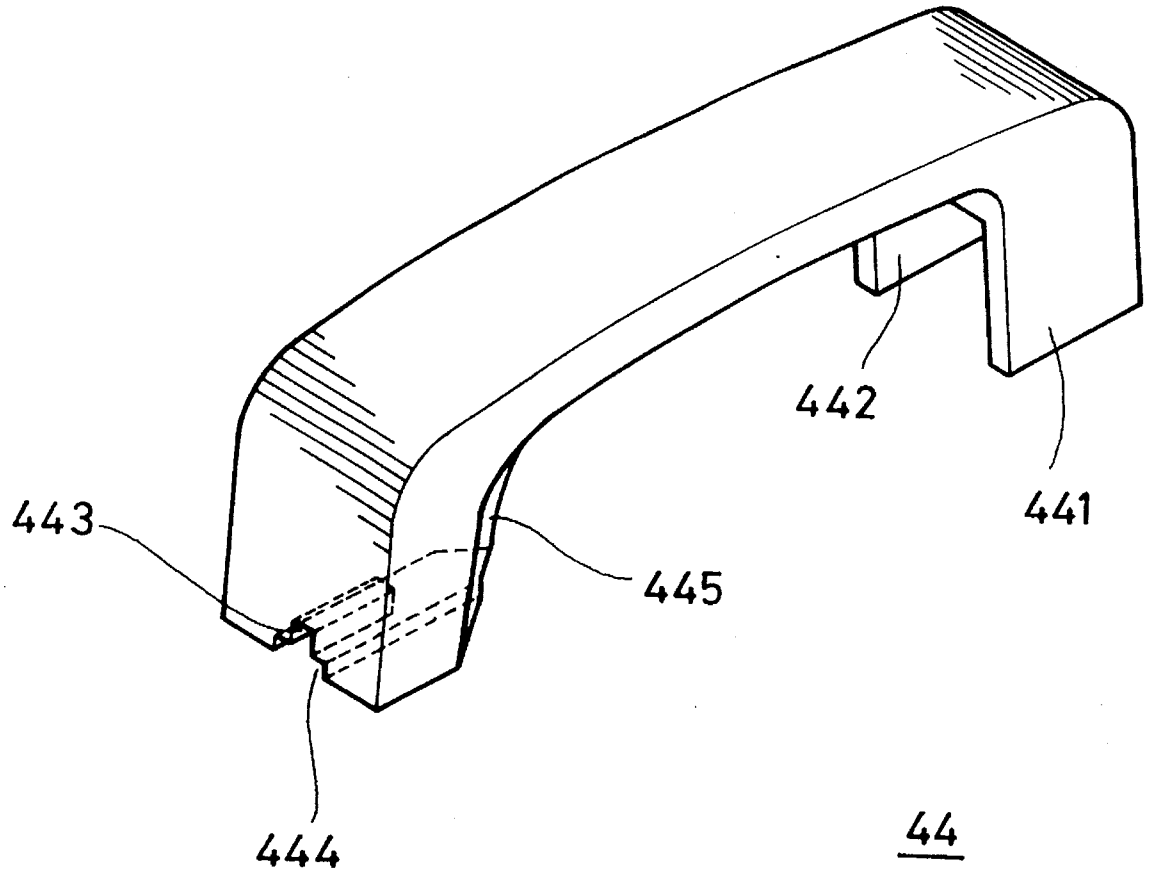
FIG. 5 is a perspective view of the lug of the automatic lock slider of FIG. 3.

Referring to FIG. 5, a lug 44 of the invention, which is substantially in the shape of arch and integrally formed with the upper side wall 421 by plastics injection molding is shown. The end of the lug 44, which is connected to the flared end of the upper side wall 421, is provided with a through hole 444 and a hole 443. The other end of the lug 44, which is connected to the contracted end of the upper side wall 421, is split into two parallel side flanges 441 and 442. A stopper 445 is formed at the inner wall of the lug 44 and near the through hole 444.

Figure 6:
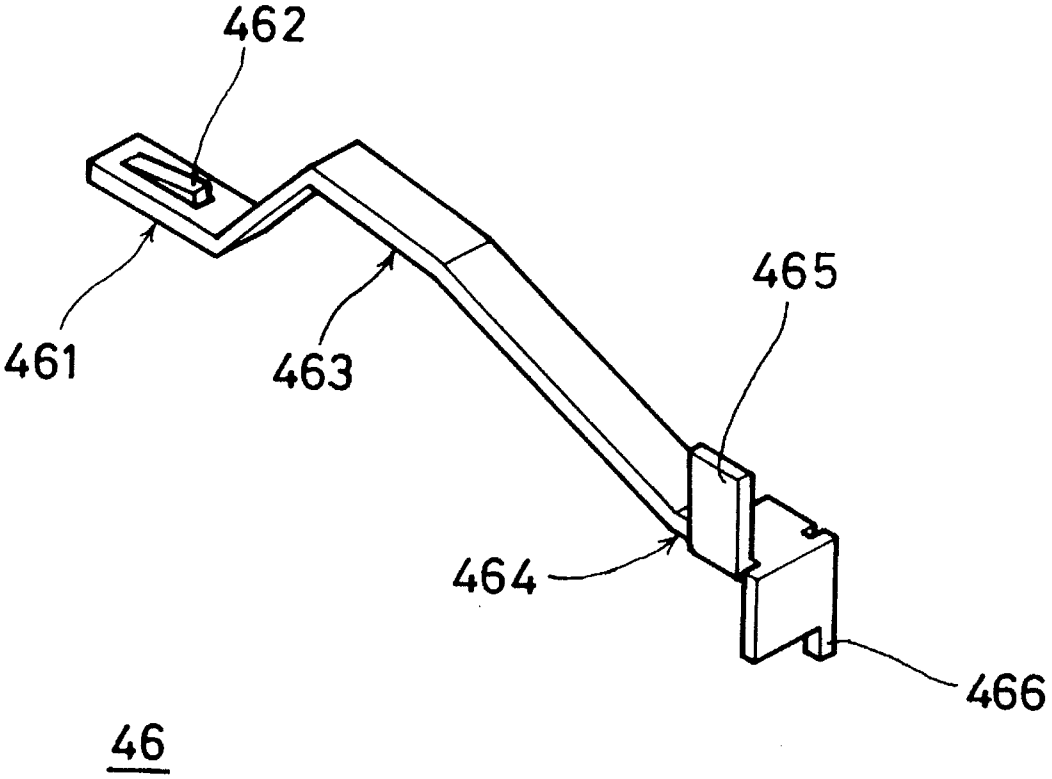
FIG. 6 is a perspective view of the elastic strip of the automatic lock slider of FIG. 3.
Figure 7:
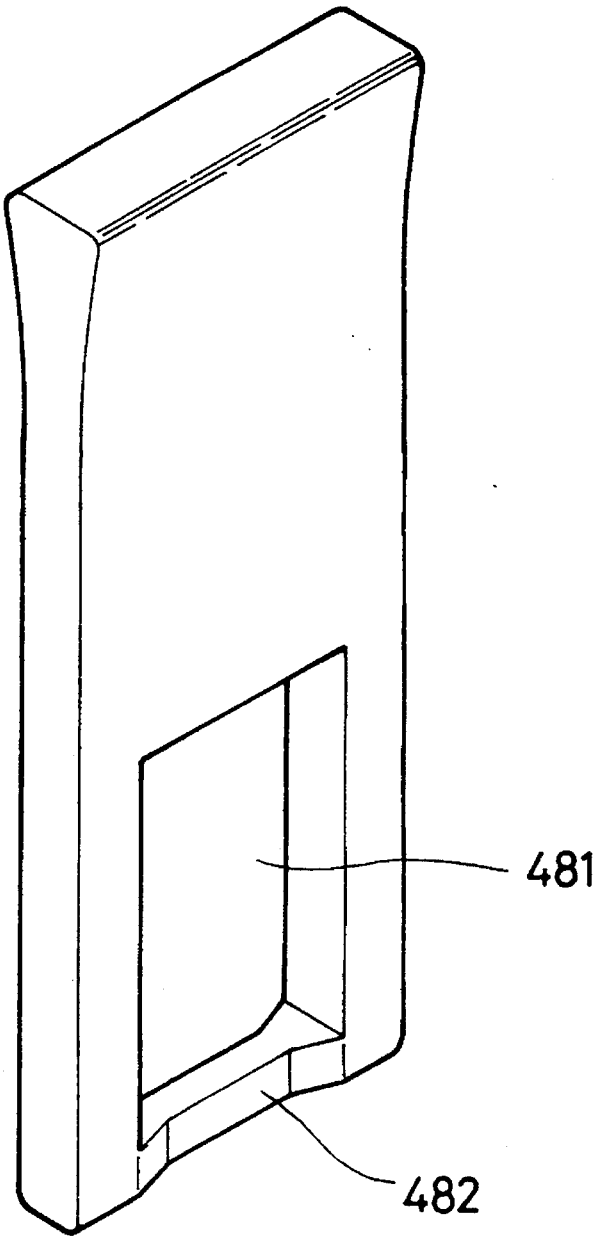
FIG. 7 is a perspective view of the pull of the automatic lock slider of FIG. 3.

The configuration of the elastic strip 46 used in the slider 40 of the invention is shown in FIG. 6. The elastic strip 46 is composed of a fixing end 461, a free end 464 and a curved portion 463. The elastic strip 46 should be made with material having sufficient elasticity, for example metal. The fixing end 461 is punched to form an engaging portion 462. The free end 464 is provided with a downward protrusion 466 and an upward protrusion 465.

The pull 48 of the slider 40 of the invention has a ring-shaped end defining an aperture 481 for circumscribing the lug 44 and the elastic strip 46. Note the end near the aperture 481 of the pull 48 is formed into a cross rod 482 and the central portion of the cross rod 482 is made thinner than its two ends to avoid the swing of the pull 48.

Figure 8:
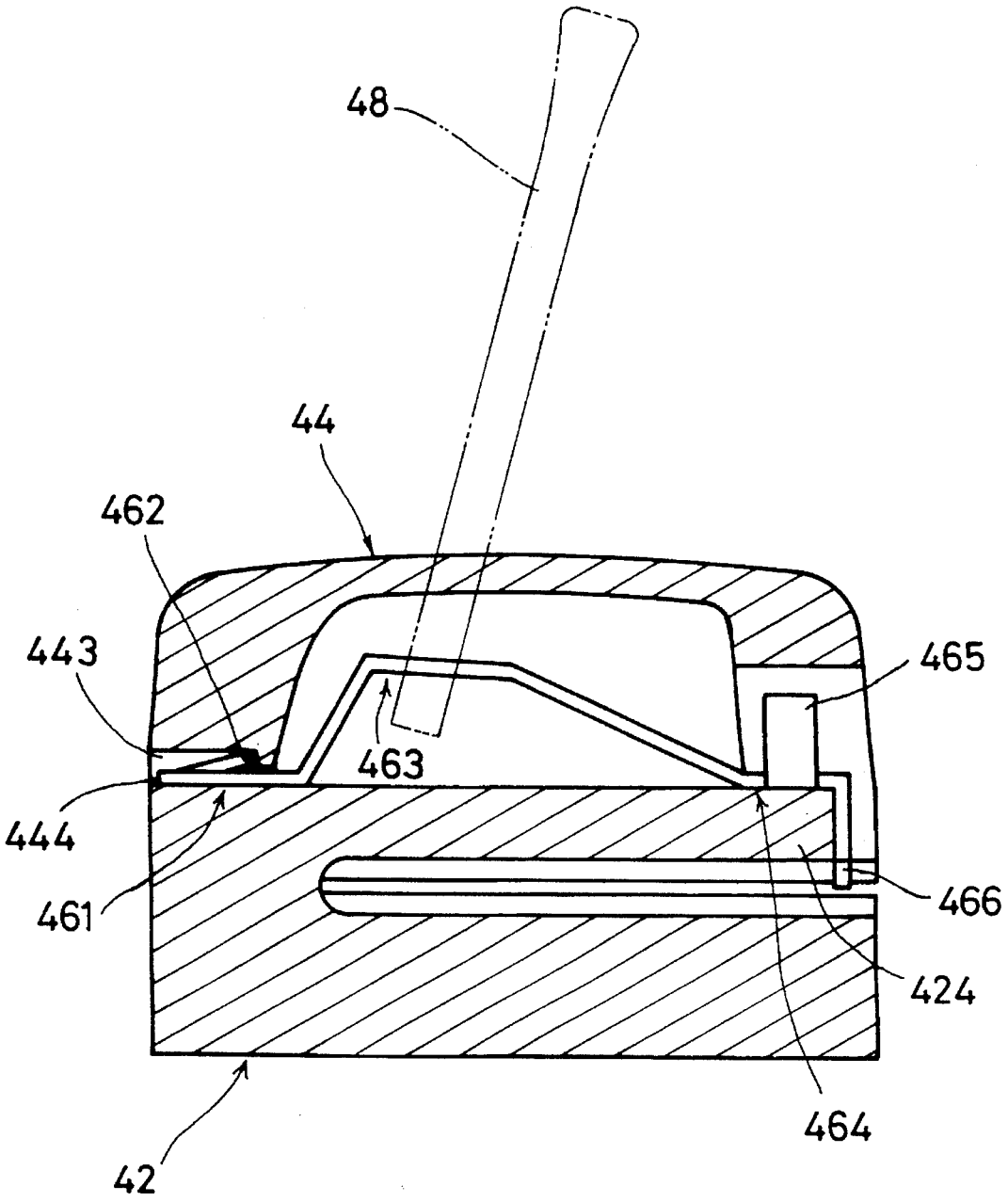
FIG. 8 is a sectional view of the automatic lock slider of FIG. 3 along the longitudinal axis thereof.

Referring now to FIG. 8, the fixing end 461 of the elastic strip 46 is inserted into the through hole 444 of the lug 44 with the engaging portion 462 being received in the hole 443, and thus is engaged therein. The free end 464 of the elastic strip 46 is therefore seated on the protruding portion 424 of the slider body 42. The aperture 481 of the pull 48 circumscribes the lug 44 and the elastic strip 46. That is, the elastic strip 46 is disposed between the lug 44 and the cross rod 482.

Figure 9:
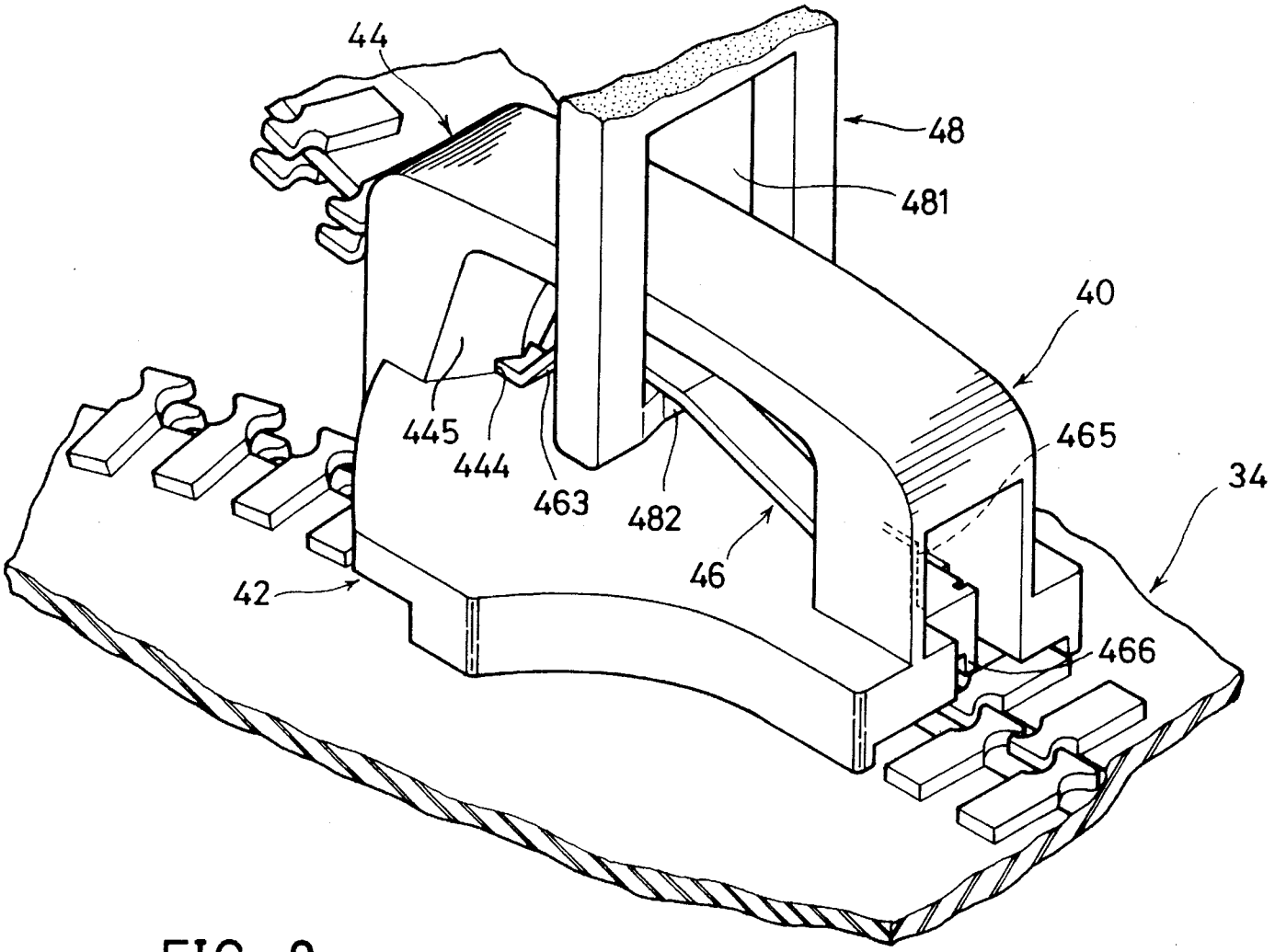
FIG. 9 is a perspective view showing the automatic lock slider of FIG. 3 mounted on the stringers.

Referring to FIG. 9, the automatic lock slider of the invention mounted on the stringers is shown. As shown in FIG. 9, when the pull 48 is released, the downward protrusion 466 of the elastic strip 46 will be forced to insert into the gap between the interlocked teeth of the stringers by the elasticity of the strip 46, thereby providing a positive locking action on the stringers to prevent the slider 40 from moving. However, when the pull 48 is pulled, the strip 46 is rotated around the through hole 444 to allow the downward protrusion 466 to detach from the gap between the interlocked teeth so that the slider is operated.

Referring again to FIG. 9, when the pull 48 is pulled to engage the interlocking teeth of the stringers, the elastic strip 46 will be forced to rotate upward, and thus the curved portion 463 of the strip will come into contact with the stopper 445 to stop the rotation. When the pull 48 is pulled to disengage the interlocking teeth of the stringers, the elastic strip 46 will also be forced to rotate upward, however, the upward protrusion 465 at the free end of the strip 46 will come into contact with the lug 44 to stop the rotation. Accordingly, by providing the stopper 445 and the upward protrusion 465, the distance from the lug 44 to the upper side wall 421 can be made higher for the easy installation of the flexible strip 46, and the elastic fatigue of the flexible strip 46 can be avoided. In addition, the cross rod 482 can be integrally formed with the pull body by plastics injection molding to reduce the manufacturing cost.

While the invention has been described in terms of what is presently considered to be the most preferred embodiment, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. An automatic lock slider for engaging and disengaging the interlocking teeth of the stringers of a slide fastener by moving on the stringers, comprising:

a slider body including a first side wall, a second side wall and a wedge-shaped portion which joins said first side wall and said second side wall and forms notches for receiving the stringers, said first side wall having a flared end and a contracted end;

an arch-shaped lug member having a first end connected to said flared end of said first side wall, and a second end connected to said contracted end of said first side wall;

an elastic strip member including a fixing end, a free end and a curved portion formed integrally with said fixing end and said free end and extending between the fixing end and the free end, said elastic strip member being disposed between said first side wall and said lug member, said fixing end being engaged with said first end, said free end being positioned at said second end and having a first protrusion adapted for movement into and out of the gap between the interlocked teeth and a second protrusion adapted for movement into and out of contact with the inner wall of said lug member whereby when the second protrusion is in contact with the inner wall of said lug member, the first protrusion is out of the gap between the interlocked teeth; and a pull member having a ring-shaped end defining an aperture circumscribing said lug member and said elastic strip member.

2. The automatic lock slider as claimed in claim 1, wherein a stopper is provided at the inner wall of said lug member near said flared end of said first wall.

3. The automatic lock slider as claimed in claim 1, wherein the end near said aperture of said pull member is formed into a cross rod having a central portion and two ends and said central portion is thinner than the two ends.

4. The automatic lock slider of claim 1, wherein the first protrusion has a distal end and the second protrusion has a distal end and wherein the first and second protrusions are connected to the free end such that the first and second protrusions move together such that the distance between the distal end of the first protrusion and the distal end of the second protrusion does not change.

* * * * *